United States Patent [19]

Roberts et al.

[11] Patent Number: 4,639,642

[45] Date of Patent: Jan. 27, 1987

[54] SPHERICON

[75] Inventors: Thomas G. Roberts, Huntsville; Thomas E. Honeycutt, Somerville, both of Ala.

[73] Assignee: The United States of America as represented by the Secretary of the Army, Washington, D.C.

[21] Appl. No.: 684,391

[22] Filed: Dec. 20, 1984

[51] Int. Cl.[4] ..... H01J 7/46; H01J 19/80

[52] U.S. Cl. ..... 315/39; 315/4; 315/5

[58] Field of Search ..... 315/111.21, 111.31, 315/111.81, 111.91, 39, 4, 5, 5.41; 313/359.1

[56] References Cited

U.S. PATENT DOCUMENTS

| | | | |
|---|---|---|---|
| 2,848,649 | 8/1958 | Bryant | 315/5 |
| 2,925,523 | 2/1960 | Weibel | 315/4 |
| 3,022,236 | 2/1962 | Ulrich et al. | 315/39 |
| 3,944,873 | 3/1976 | Franks et al. | 315/111.81 |
| 4,080,549 | 3/1978 | Creedon et al. | 313/231.31 |
| 4,150,340 | 4/1979 | Kapetanakos et al. | 315/3 |
| 4,425,529 | 1/1984 | Leboutet | 315/5.41 |
| 4,453,108 | 6/1984 | Freeman, Jr. | 315/5.18 |

FOREIGN PATENT DOCUMENTS

| | | | |
|---|---|---|---|
| 60-54200 | 3/1985 | Japan | 315/111.21 |

OTHER PUBLICATIONS

*Microwave Engineering*, Ishii, T. K., The Ronald Press Co., New York, 1966.

*Infrared and Millimeter Waves*, Button, K. J., Academic Press, New York, 1979.

*Radar Handbook*, Skolnik, M. I., McGraw-Hill Book Co., New York, 1970.

*Primary Examiner*—David K. Moore

*Assistant Examiner*—Theodore Salindong

*Attorney, Agent, or Firm*—Freddie M. Bush; Robert C. Sims

[57] ABSTRACT

A spherical RF source tube which requires no magnetic fields for its operation which consists of two concentric spherical shells. The inner shell, which is open and which is nearly transparent to electrons, is charged positively with respect to the grounded outer shell, which is solid. The outer shell contains ports for the vacuum system, for the high voltage bushing that supports the inner shell, for the output coupling devices, and for plasma devices used in starting and maintaining operation.

10 Claims, 8 Drawing Figures

SPHERICON

DEDICATORY CLAUSE

The invention described herein may be manufactured, used, and licensed by or for the Government for governmental purposes without the payment to us of any royalties thereon.

BACKGROUND OF THE INVENTION

The largest, heaviest, and most costly part of an RF system is the transmitter. This part also draws the most prime power and requires the most cooling-factors which further influence the size, weight and cost of a system. The design of the transmitter is very strongly affected by the design of the RF tube or source. Therefore, RF-tube development has a long and varied history. These development efforts have produced the lighthouse tube, the pencil tube, the disk-sealed tetrode, the resnatron, the B-K (Barkhausen and Kurtz) tube, the klystron, the reflexklystron, the magnetron, the traveling-wave tube, the backward-wave oscillator, the platinatron, the amplitron, the stabilatron, the helitron, the spinatron, the crestatron, the larmatron, the tornadotron, the laddertron, the gyrotron, the cyclotron maser, the ledatron, and the free electron laser; to name a few.

The concept of energy conversion between the electron beam and electromagneic waves and principles of operation of these devices are discussed by T Koryu Ishii in "MICROWAVE ENGINEERING", The Ronald Press Co. New York, 1966; Kenneth J. Button in "Infrared and Millimeter Waves", Academic Press, New York, 1979; and Merrill I. Skolnik in "Radar Handbook", McGraw-Hill Book Co., New York 1970.

Most of these are relatively inflexible special-purpose devices and many of them require the production and control of high voltage electron beams, magnetic guide fields, and in some cases magnetic wiggler fields. Others are crossfield devices where the electric and magnetic fields are perpendicular to each other with the magnetic field being used to cause the electron beam to curve or rotate. In some cases, as with the traveling-wave tube the backward-wave oscillator, the cyclotron maser, and the free electron laser, it is necessary to establish and maintain a phase match between electromagnetic radiation and the electron beam. In all cases, they are complex and they are sometimes difficult to utilize.

SUMMARY OF THE INVENTION

It is an object of this invention to provide an RF tube which requires no magnetic field (only electrostatic fields) and is simple.

Another object is to provide an RF tube which may be operated in either a continuous-wave (CW) mode or a high-power pulsed mode.

Still another object is to provide a plasma source for use in the high-power pulsed mode, and the CW mode.

DETAILED DESCRIPTION OF THE INVENTION

Figure 1:
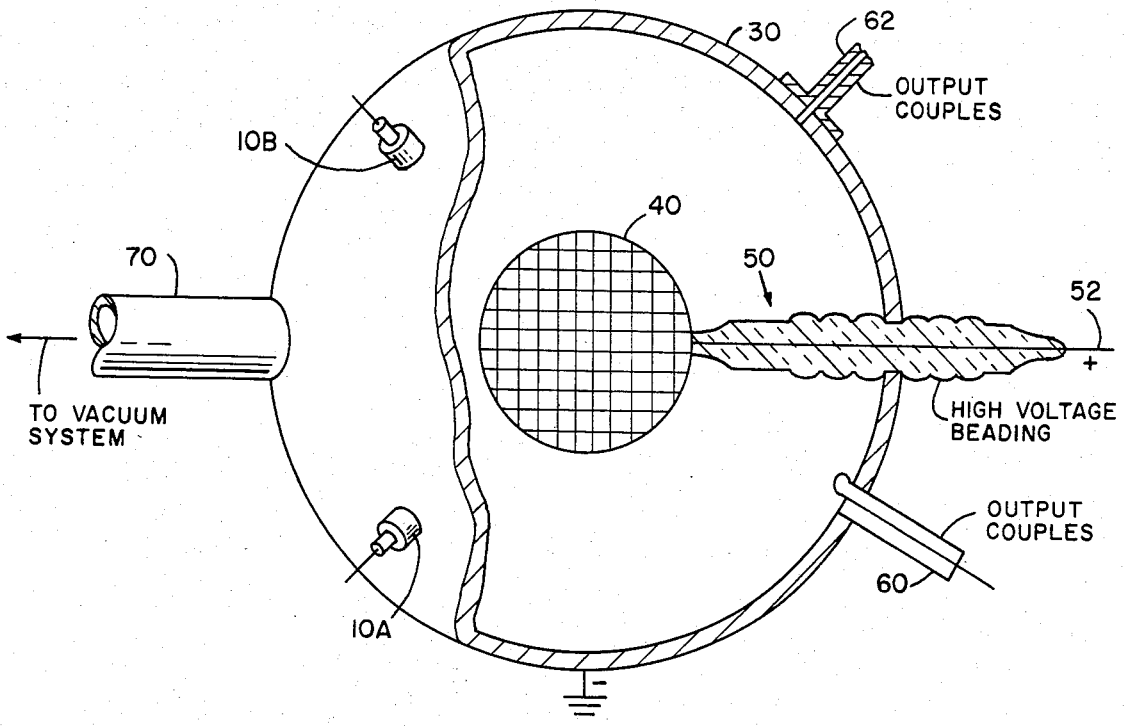
FIG. 1 is a diagrammatic illustration of the Sphericon partially cutaway.
Figure 2:
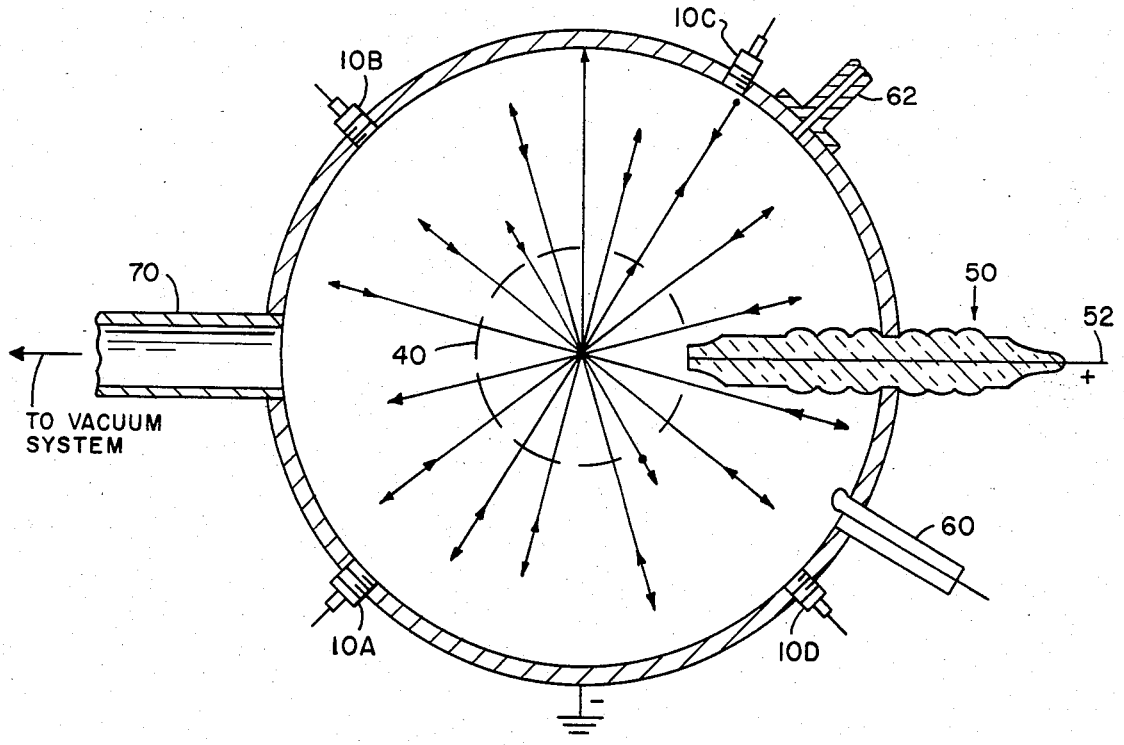
FIG. 2 is a schematic illustration of the Sphericon.
Figure 3:
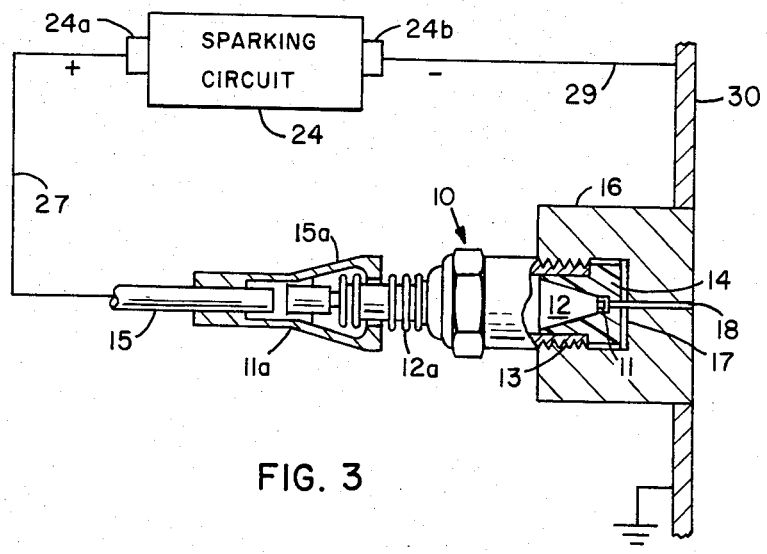
FIG. 3 is a schematic illustration of the small plasma jet charged particle source.

Referring to FIGS. 1 and 2, the Sphericon consists of an outer spherical electrode 30 which is held at ground potential, and a spherical inner electrode 40 which is made of a mesh or a grid material and is maintained at a high potential. The inner electrode 40 is held in place by the member 50 which is a high voltage corrugated bushing and contains the conductor 52 for the positive voltage input. Two methods of extracting output electromagnetic radiation from the cavity formed by the electrodes are shown. One is a coaxial-loop pick-up 60 and the other is a waveguide output coupler 62. On the left is a port 70 through which the vacuum inside sphere 30 is produced and maintained. The connection 70 is covered by two or three layers of copper screen wire so as to confine most of the fields to the interior of sphere 30. The vacuum system is not shown but it may be such that the tube may be sealed off after the vacuum has been produced. The vacuum may be maintained by use of small ion pumps, cryogenic pumps, or chemical getter pumps. The remaining components are the plasma jet charged particle sources 10A–10D shown (a plurality of others, not shown, may be distributed evenly about the sphere 30.) The plasma jet charged particle source is illustrated in FIG. 3. A spark-plug-like device 10, similar to those used in automobile engines, only smaller, has a center electrode 11 and center insulator 12 which extends beyond the threaded metal body 13 of the plug. A plastic insert 14 is inserted around the center insulator 12. The numeral **12*a* designates the extension of the center insulator 12, and 11*a* is the extension of the center electrode 11, to which high voltage lead 15, with insulating boot 15*a*, is connected. The plasma jet charged particle source metal housing wall is member 16, and member 17 is a noncorroding metal gasket inserted between the insert 14 and the bottom of a threaded-bore into which body 13 of the plug is screwed. A bore 18 passes between the electrode 11 and the interior of the housing 16. The insert 14, in this embodiment, is made of lucite, but many other substances could be used. Polythylene or other linear polymers as well as teflon and other fluorocarbon polymers could be used. Other polymers or substances may be used, the requirements being; a dielectric: which does not shatter readily under electrical or the stresses developed in the plasma jet charged particle source; which is readily vaporizable by a spark discharge along its surface; which leaves no significant ash upon vaporization; and which does not continuously out-gas. Gasket 17 may be brass, copper, stainless steel, tantalum, or some other noncorroding metal. The gasket is not absolutely necessary, but is convenient because it prevents wear on housing 16. The member 30 is the outer electrode of the Sphericon. A sparking circuit 24, with a high voltage terminal 24*a* and a ground (negative) terminal 24*b*, has its high voltage terminal connected to high voltage lead 15 by lead 27, and its ground terminal connected to housing member 16 by lead 29. A plasma source which produces low energy electrons is desired to prevent over-travel and capture of electrons by 30**.

In operation in its most simple form, the Spericon is first evacuated, a high positive voltage is applied to the inner electrode 40 and the plasma jet charged particle sources are sparked for a predetermined period of time. When the sources are sparked a portion of the plastic inserts 14 is ablated, and the plasma produced expands through the passage 18 into the interior of the outer electrode 30. Here the ions are attracted to, and are collected by, the outer electrode 30 so as to remove them from the chamber inside 30. The electrons are attracted by the inner electrode 40 and are accelerated toward it by the electric field which exists between the electrodes 30 and 40. When these electrons reach the electrode 40 they have gained considerable velocity and momentum and they pass through to the outside of electrode 40 without further acceleration. After leaving the surface of 40 they propagate toward the outer electrode 30 while being deaccelerated by the electromagnetic radiative losses, output losses, etc., and are stopped before reaching the outer electrode. At this turning point the electrons are again accelerated back toward the inner electrode 40 and pass through again, that is, they oscillate. The neutral particles which were injected by the charged particle source tend to fill the Sphericon until they are either pumped out or are struck by one of the oscillating electrons which causes them to become ionized. In this event the ion drifts toward the outer electrode where it is collected and the extra electron is accelerated towards the inner electrode where it becomes one of the oscillating electrons and contributes to the output of the device.

The inner electrode 40 is made of a wire mesh material in a manner such that it is nearly all open, say with an open area which exceeds 90%. Thus very few electrons are intercepted by this electrode until they have radiated their energy to the RF fields within the cavity and have slowed down until their oscillation amplitude is small and they are captured by electrode 40.

This mode of operation is called the pulsed mode. The output pulse width of the Sphericon is determined by the time for the oscillating electrons to radiate their energy and be collected by the inner electrode. The amplitude of the output is determined by the number of electrons oscillating, and the frequencies produced are determined by the accelerations given the electrons.

Figure 4A:
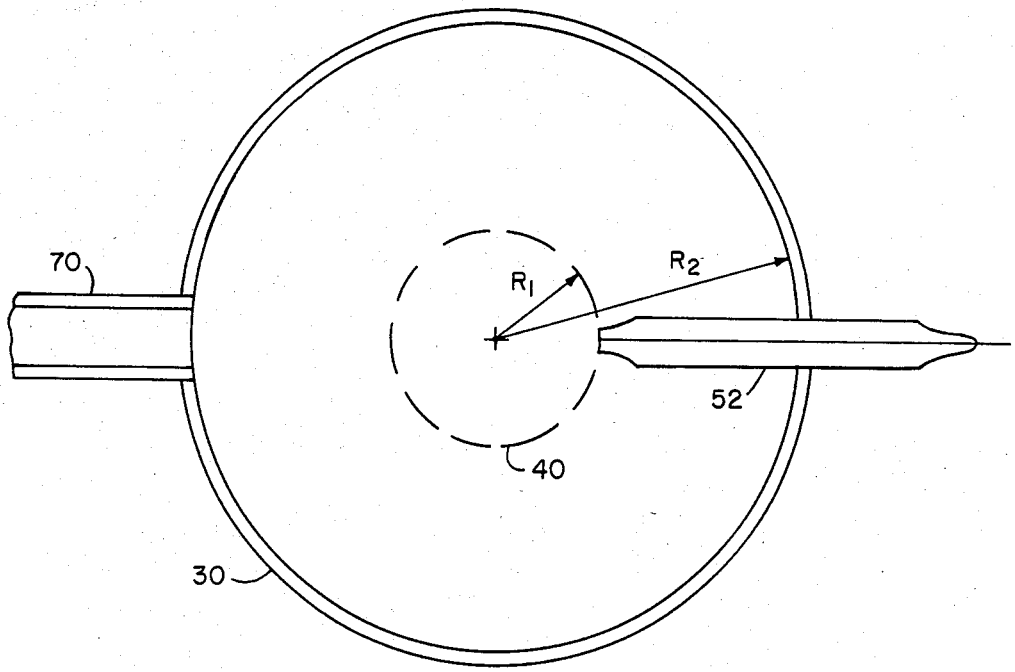
FIGS. 4A–4C are schematic illustrations showning how the electric field and the electric potential fall off with radius.
Figure 4B:
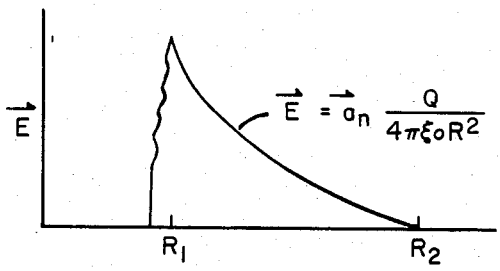

The arrows in FIG. 2 are to indicate the orbits of electrons with no angular momentum or the projection of orbits of electrons with angular momentum onto the plane of the figure. The force on the electrons is given by:

$$\vec{F}=e(\vec{E}+\vec{v}X\,\vec{B})=e\,\vec{E}, \qquad (1)$$

since $\vec{B}$ is zero and as can be seen in FIG. 4B, $\vec{E}$ is given by:

$$\vec{E}=O \text{ for } R\leqq R_1, \qquad (2)$$

where R is a radius measured from the center of the Sphericon and $R_1$ is the radius of electrode 40.

$$E = a_r\frac{Q}{4\pi\epsilon_o R^2} \text{ for } R_1 \leqq R \leqq R_2. \qquad (3)$$

Here $\vec{E}$ is the electrostatic field, $\vec{a_r}$ is a unit vector in the radial direction, R is the magnitude of the electron's position relative to the center of the electrodes, $R_2$ is the radius of sphere 30, Q is the charge on the electrode 40, and $4\pi\epsilon_o$ is a constant.

If we use equation (1) in Newton's Law, we get something which is similar to a moving particle attracted to a fixed point 0 by a central force which varies inversely as the square of the distance of the particle from 0. That is like a sun with only one planet where the motion of the planet is a conic having a fixed focus, except that in one case some of the particles pass through the field-free region of the inner electrode where they are not accelerated and just drift with the velocity which they acquired at $R=R_1$. In this case the orbit may not be closed but, nevertheless, they are oscillatory. Note that it is not necessary that the orbits penetrate the inner electrode but the projection of their orbits on a plane containing the origin 0 will penetrate this electrode as shown in FIG. 2.

Quantum mechanically this problem is similar to the hydrogen atom problem with the above mentioned exception for those orbits which penetrate the inner electrodes, and it could be solved by quantum mechanical methods.

In any case, the electrons are accelerated in a manner that makes their motion oscillatory. This acceleration leads to radiated electromagnetic fields where the electric field vector of the radiated electromagnetic field is proportional to the acceleration of the electron at the retarded time $(T-r^1/C)$. The magnetic field vector B is given by $C\vec{B}=\vec{e_r}1X\,\vec{E}$. Here $r^1/C$ is the time it takes, at the speed of light, C, to get from the position of the electron to the point P where the values of the fields are being determined and $r^1$ is the distance from the electron to the point P. Also $\vec{e_r}1$ is a unit vector in the $r^1$ direction.

For those electrons with initial values for $\theta$ such that their orbits do not penetrate the inner electrode the problem is exactly the same as its classical and quantum mechanical counterparts.

The above treatment, although very complicated, has been somewhat simpified in that the effect of the space charge produced by the electrons themselves has been neglected.

In summary, the electrons are accelerated; they oscillate and they radiate electromagnetic energy into the interior of electrode 30. The frequency content of this radiation is determined by the oscillatory nature of the electrons and some of this energy is coupled out for use by members 60 and 62.

There are several pulsed plasma units 10 shown in FIG. 2. However, one may be adequate but more than one may be needed for optimum operation. Other devices which produce electrons in large quantities with low energy may be used in place of the plasma producing units 10.

When operated in the CW mode, the pulsed plasma sources 10 are replaced with a small low pressure glow discharge where the pressure is maintained only slightly higher than the very low pressure that is maintained in the interior of electrode 30. In this manner a small amount of plasma is continuously supplied to the space between electrodes 30 and 40, so that electrons are replaced at a rate equal to their loss rate.

In either mode of operation the positive voltage applied to electrode 40 via lead 52 can be modulated so as to influence the acceleration of the electrons to produce radiation with peaks at desired frequencies. This complicates the analysis of this problem further and the modulation frequencies and modulation amplitudes desired will have to be determined by experiment before the tunability of the device can be fully understood.

Figure 5:
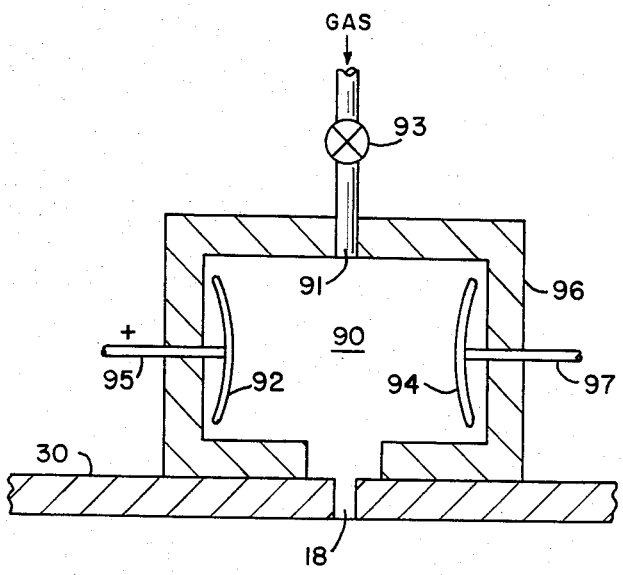
FIG. 5 is a schematic illustration of a CW plasma source.

FIG. 5 has been added to illustrate a CW plasma source which can replace elements 10A–10D for CW operation. It consists of a low pressure glow discharge area 90 between electrodes 92 and 94. These electrodes are held in a housing 96 which is made of an insulator-like quartz, glass, or ceramic. Gas is admitted to 90 through port 91 and control value 93. Lead 95 is used to keep electrode 92 at a positive potential and lead 97 is used to keep electrode 94 at a negative potential with respect to 92 but at a potential that is slightly positive with respect to electrode 30 which is at zero potential. The power supply, not shown, for this source is much like that for a fluorescent light.

Figure 6:
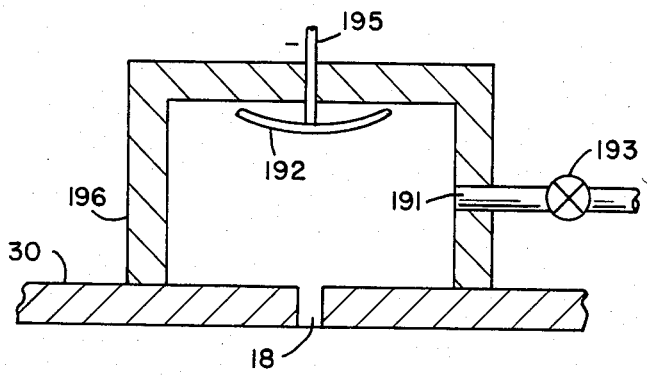
FIG. 6 is a schematic illustration of another CW plasma source.

A simpler method here would be as indicated in FIG. 6 where electrode 30 is used as one of the electrodes. In this case, the discharge takes place between the electrode 192 and 30 itself. The electrode 192 is negative with respect to 30 and electrons are attracted toward 30 where some of them pass through 18 and enter 30 along with some neutrals. In both FIGS. 5 and 6, the housing 96 and 196 are epoxied to 30 using a low-vapor-pressure material like Torr-seal or its equivalent.

The spherical geometry is chosen because it is the only geometry in which the static electric field has only a radial component and other applied external fields, such as magnetic fields, are not required for confinement purposes. The voltages required may be estimated by considering a formula. This formula may be derived by estimating the time required for an electron to go back and forth across the sphericon realizing that it undergoes constant acceleration in the region between the electrodes; or by recognizing that 2eV/m is the velocity that a particle gains in falling through the potential V. In either case the frequency is given by $$f = \frac{\left[\sqrt{\frac{2e}{m}}\right]\left[\sqrt{V}\right]}{4(2R_2 - R_1)}.$$

Here e/m is the charge-to-mass ratio of the electron, V is the potential between the electrodes, and $R_2$ and $R_1$ are defined as before (See FIG. 4A). Choosing 0.05 meters for $R_1$ and 0.1 meters for $R_2$ gives $$f = 10^6\sqrt{V}$$

and to obtain a frequency of $10^8$ Hz requires $10^4$ volts. This voltage is considered not to be high when compared to the multimegavolts required by the cyclotron maser, the free electron laser and other devices which utilize relativistic electron beams.

Figure 4C:
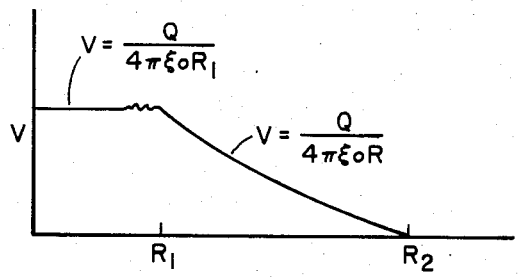

Referring to FIGS. 4A–4C, the plasma generator is provided as a source of electrons because we require, in the pulsed mode, a large bunch of electrons with nearly zero energy to be borne near $R_2$ as shown by FIG. 4C. If the energy associated with the radial component is not near zero then the electron will be able to climb the potential hill between $R_1$ and $R_2$ on the other side of the sphericon and be collected at the cathode, thus preventing oscillations from occurring. The energy of electron will stay the same inside of R1 as shown by FIG. 4C. FIG. 4B is an illustration of $\vec{E}$ which is the differential of the data of FIG. 4C. The energies of the electrons produced by the plasma sources is of the order of one electron volt; and only a fraction of this energy is associated with the radial component of velocity. Thus the energy losses due to radiation can cause most of the electrons not to reach $R_2$ as it becomes 0 as shown by FIG. 4C. Therefore, the electrons continue to oscillate until they lose all of their energy to radiation or until they are collected at $R_1$. This same requirement applies to the continuous mode of operation except that now we want a continuous supply of low energy electrons but at a lower peak current.

The problem to be solved before a complete understanding of the theory of operation of the sphericon can be obtained is the same as that of an "atom" with a very large atomic number. The atomic number would be greater than the number of electrons in the space between $R_2$ and $R_1$. The electrode at $R_1$ is like a screened nucleus. However, this "atom" is not in its ground state. It has the electrons between $R_2$ and $R_1$ excited to very high Rydberg states, and because the quantum numbers for these states are so large the problem can be treated accurately by classical means. In this analogy, an electron acquiring enough energy to reach $R_2$ and be collected is the same as the "atom" becoming ionized. An electron being collected at $R_1$ is the same as it reaching its "place" in the ground state and becoming part of the screen for the nucleus. The ability to treat the problem classically, however, does not make it simple, and as far as is known this problem can not be solved. Some understanding of the behavior of this system can be obtained by solving simpler but related problems. For example a zeroth order treatment or first approximation may be obtained by treating each particle as moving only in the central force field with no angular momentum, as was done in obtaining the formula for the frequency. Then effects of some initial angular momentum may be included as was done in the disclosure. Next one would like to include the effects of the space charge produced by the oscillating electrons and then the effects of the self-magnetic fields produced by currents of the oscillating electrons. At this point the oscillating electromagnetic field of the cavity modes might be included as a perturbation. The point to be made here is that we can only estimate things theoretically, and we can only know those things which we can determine experimentally.

We claim:

1. A RF energy producing device comprising a spherical outer electrode; first means for producing electrons; second means for injecting the electrons inside said spherical electrode; a second spherical inner electrode positioned symmetrically inside said outer electrode; third means connected to said inner electrode so as to make said inner electrode a positive voltage potential relative to said outer electrode; and said inner electrode being substantially open in construction so that most electrons will be accelerated by the voltage potential and will not be collected by the inner electrode but will oscillate about the electrodes creating RF energy.

2. A device as set forth in claim 1 further comprising a fourth means connected to said outer electrode so as to collect RF energy therefrom.

3. A device as set forth in claim 1 wherein said first means produces low energy electrons and inserts them just inside said outer electrode for acceleration by the voltage potential.

4. A device as set forth in claim 3 wherein said first means produces a plasma having a large proportion of electrons and some ions; and said outer electrode being grounded and designed to collect the ions.

5. A device as set forth in claim 4 further comprising a vacuum means connected through said outer electrode for maintaining a vacuum within said outer electrode and for evacuating any neutral particles that may have been injected into the device.

6. A device as set forth in claim 5 further including a plurality of said first means located symmetrically about said outer electrode.

7. A device as set forth in claim 6 further comprising a fourth means connected to said outer electrode for collecting the RF energy generated.

8. A device as set forth in claim 7 wherein said electrons are injected into the outer electrode in a pulse manner, so as to operate the device in a pulse mode.

9. A device as set forth in claim 7 wherein said electrons are continually being injected into said outer electrode at a rate approximately equal to a rate that electrons are being collected by said inner electrode.

10. A device as set forth in claim 1 wherein only electrostatic fields are present for operation of said device.

* * * * *